US007232320B2

(12) United States Patent
Kuo

(10) Patent No.: US 7,232,320 B2
(45) Date of Patent: Jun. 19, 2007

(54) CARD CONNECTOR

(75) Inventor: Ming-Lun Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/363,645

(22) Filed: Feb. 27, 2006

(65) Prior Publication Data

US 2006/0194461 A1 Aug. 31, 2006

(30) Foreign Application Priority Data

Feb. 25, 2005 (TW) ..... 94203012 U

(51) Int. Cl.
*H01R 13/62* (2006.01)

(52) U.S. Cl. ..... 439/159; 439/630

(58) Field of Classification Search ..... 439/159, 439/157, 630

See application file for complete search history.

(56) References Cited

U.S. PATENT DOCUMENTS 5,871,365 A * 2/1999 Kajiura ..... 439/159
6,080,017 A * 6/2000 Yu et al. ..... 439/607
6,382,994 B1 5/2002 Chang
6,739,890 B2 * 5/2004 Hirata et al. ..... 439/159
6,790,061 B1 * 9/2004 Lai et al. ..... 439/159
6,932,632 B1 * 8/2005 Lai ..... 439/157
6,986,675 B2 * 1/2006 Takada ..... 439/159
6,988,904 B1 * 1/2006 Lai ..... 439/159
7,037,123 B2 * 5/2006 Nakamura et al. ..... 439/152
7,118,396 B2 * 10/2006 Ting ..... 439/159
2003/0124890 A1 * 7/2003 Harasawa et al. ..... 439/159
2005/0079766 A1 * 4/2005 Ho et al. ..... 439/630

FOREIGN PATENT DOCUMENTS

TW 092220363 11/2004

* cited by examiner

*Primary Examiner*—Hae Moon Hyeon
(74) *Attorney, Agent, or Firm*—Wei Te Chung

(57) ABSTRACT

A card connector comprises an insulating housing; a plurality of contacts retained in the insulating housing; a shielding provided with one end along a card inserting direction coupled on the housing, and defining a card receiving space together with the insulating housing with a card inserting opening at the other end of the shielding, the shielding having a pair of opposite side edges, one of the side edges being in substantially linear configuration and the other of the side edges being in a step configuration so that the width of the card inserting opening is wider than that of the insulating housing; and an ejector assembled on the shield for ejecting the card.

19 Claims, 6 Drawing Sheets

CARD CONNECTOR

BACKGROUND OF THE INVENTION

1. Field of the Invention

The present invention is generally related to card connectors, and more particularly, to a card connector with an ejector.

2. Description of Related Art

Most notebooks are provided with PC card connectors for accommodating PC cards as storage mediums. For adapting to developments of the communication technology and electronical technology, the industry standard of the PC card need to update ceaselessly. According to the newest industry standard (Expresscard PC Card Standard), express cards which have more quicker speed than conventional PC cards at data transmission are achieved. Thus, express card connectors are also achieved for receiving express cards. The express card has two types in configuration, one is rectangle and another is L-shaped.

TaiWan Patent Application No. 092220363 discloses a card connector without an ejector. The card connector can receive two types express card. When drawn the card out of the card connector, it is done by hand directly However, when the express card is fully inserted into a card receiving space of the card connector, the card connector almost encloses the express card. Thus, when we want to draw the card out of the card connector by hand directly, it is inconvenient to do, especially when the card connector is assemble on electronic devices.

Hence, an imporved card connector is required to overcome the disadvantages of the related art.

SUMMARY OF THE INVENTION

Accordingly, an object of the present invention is to provided a card connector which has an ejector.

To achieve the above objects, a card connector comprises an insulating housing; a plurality of contacts retained in the insulating housing; a shielding provided with one end along a card inserting direction coupled on the housing, and defining a card receiving space together with the insulating housing with a card inserting opening at the other end of the shielding, the shielding having a pair of opposite side edges, one of the side edges being in substantially linear configuration and the other of the side edges being in a step configuration so that the width of the card inserting opening is wider than that of the insulating housing; and an ejector assembled on the shield for ejecting the card.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
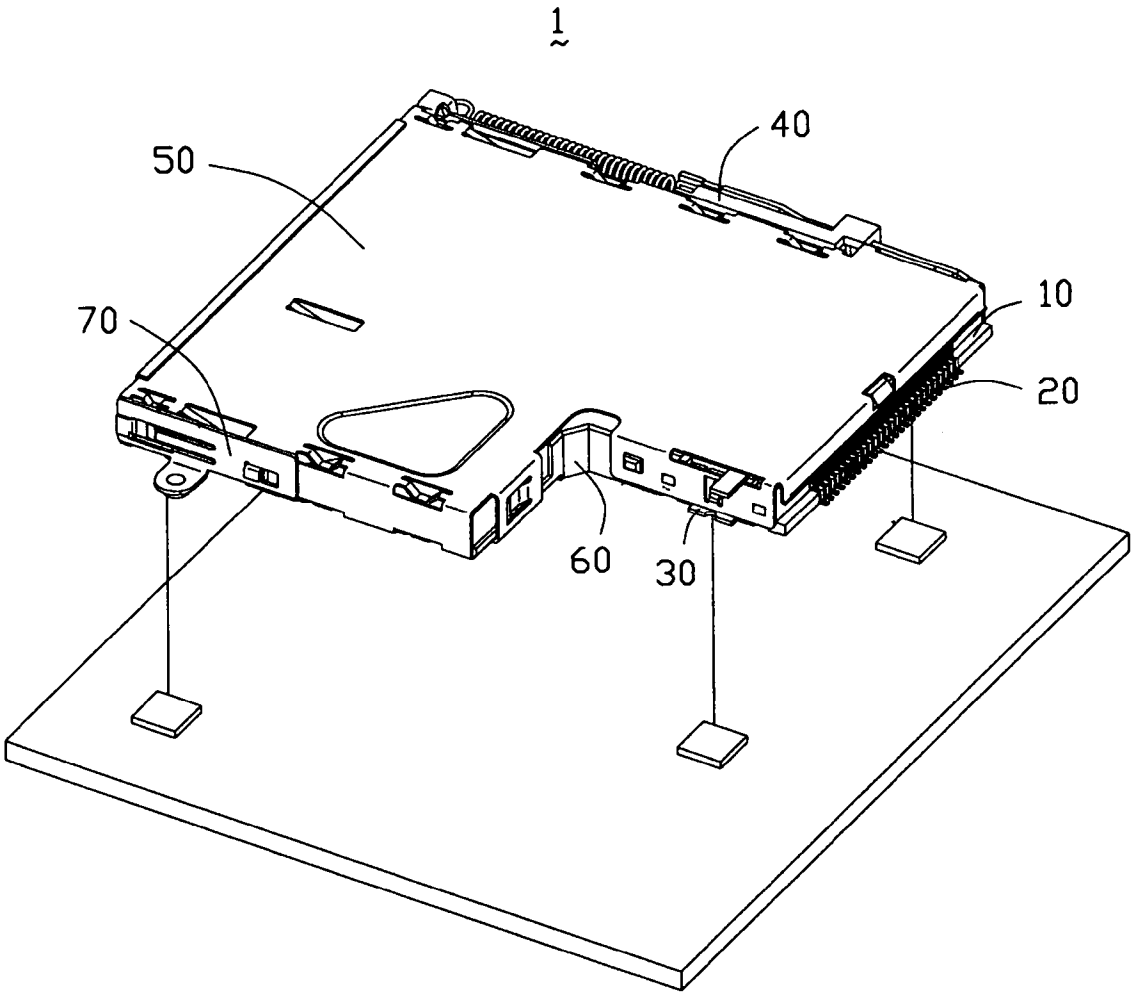
FIG. 1 is a perspective view of a card connector in accordance with the present invention and a printed circuit board to which the card connector is to be mounted.

Referring to FIG. 1, a card connector 1 in accordance with the present invention is approximately L-shaped. The card connector 1 comprises an elongated insulating housing 10 with a plurality of contacts 20 being received in, a pair of soldering pieces 30 disposed in opposite sides of the insulating housing 10, a L-shaped shielding 50 covered the housing 10, a guide element 60, a pair of stand off devices 70 and an ejector 40 disposed on the shielding 50.

Figure 2:
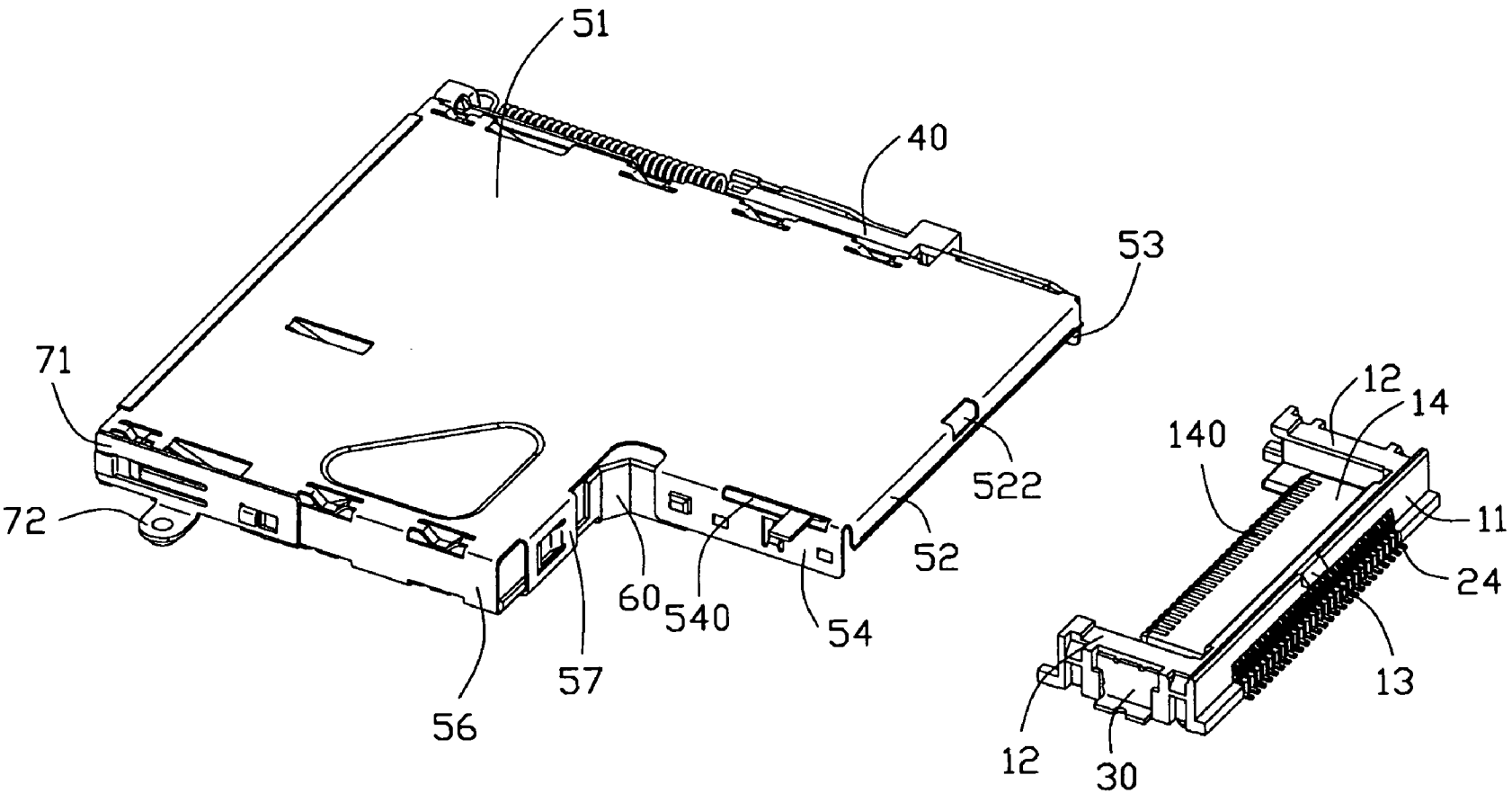
FIG. 2 is a perspective view of the electrical card connector shown in FIG. 1 with a shielding being apart from a housing.
Figure 3:
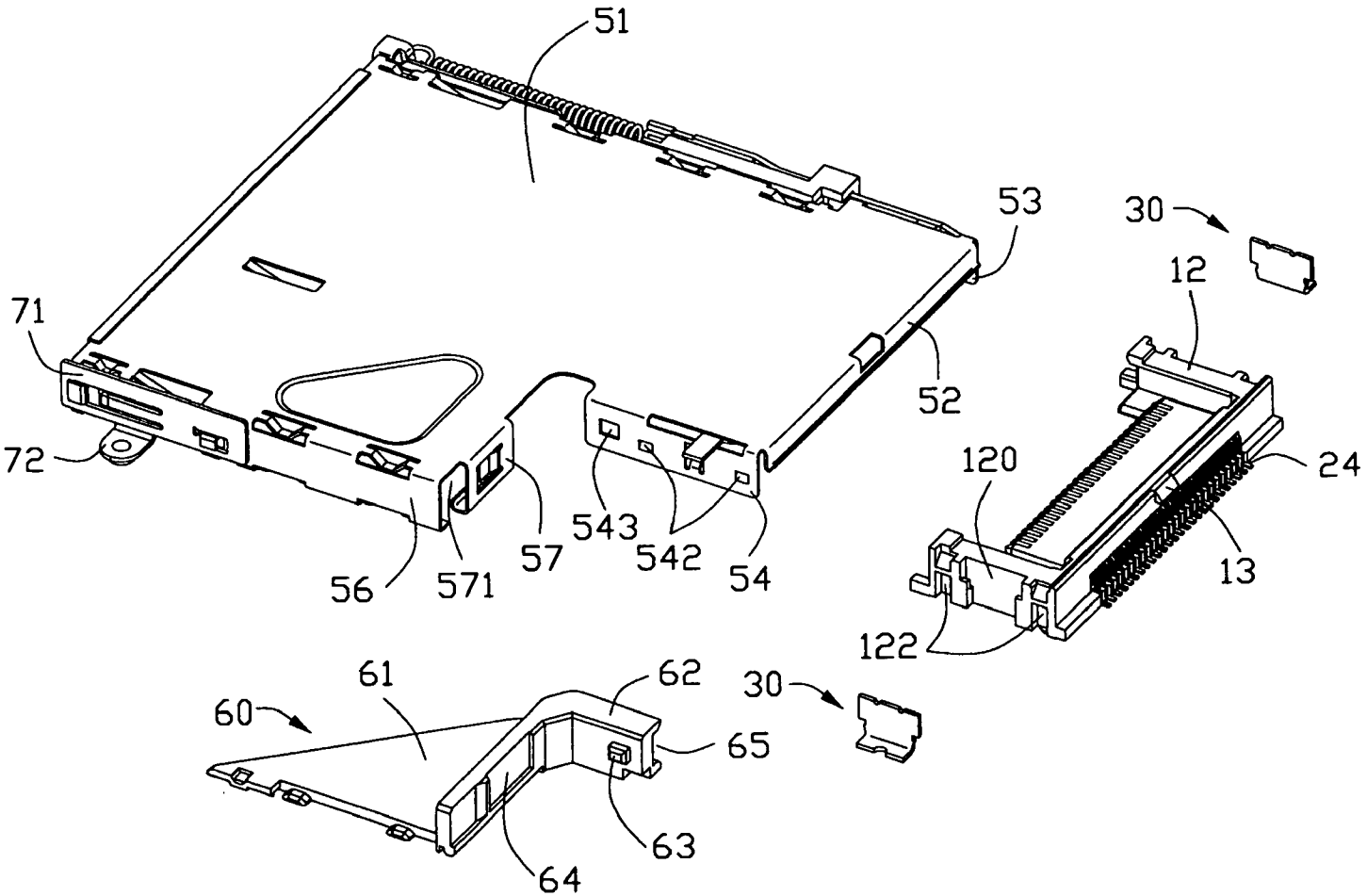
FIG. 3 is an exploded perspective view of the card connector shown in FIG. 2.

Referring to FIGS. 2 and 3, the elongated insulating housing 10 has a base 11, a pair of guiding arms 12 extending backwardly from opposite sides of the base 11 and a mating portion 14 extending from a lower part of the base 11 and disposed between the two guiding arms 12. Each guiding arm 12 defines a slot 120 extending downwardly from an upper surface thereof and a plurality of latch holes 122 besides the slot 120. The contacts 20 are received in a plurality of parallel channels 140 formed in the mating portion 14. Each contact 20 comprises a contact portion 22 for electrically connecting with cards, a tail portion 24 for electrically connecting with a printed circuit board and a fixing portion (not shown) connected the contact portion 22 and the tail portion 24. The soldering pieces 30 are inserted into the slots 120 of the guiding arms 12, respectively.

Referring to FIGS. 2 to 5, the shielding 50 coupled on the housing 10 is formed and stamped a metallic sheet. The shielding 50 has a main body 51 in L-shaped and a plurality of side edges extending downwardly from edges of the main body 51 to form a card receiving space 58 for accommodating cards cooperating with the main body 51, that is to say, length of one part of the shield adjacent to the housing being longer than that of another part thereof adjacent to the card inserting opening along a transverse direction. These side edges comprise a front wall 52 extending downwardly from a front edge of the main body 51, a first and a second side edges 53, 54 at opposite sides of the front wall 52, a third side edge 55 disposed in the same side with the first side edge 53, a fourth side edge 56 disposed in the same side with the second side edge 54 and a longitudinal side edge 57. The first and the second side edges 53, 54 are respectively adjacent to opposite ends of the front wall 52, the third and the fourth side edges 55, 56 are respectively parallel to the first and the second side edges 53, 54, and the longitudinal side edge 57 is disposed between the second side edges 54 and the fourth side edge 56.

When the shielding 50 is assembled on the insulating housing 10, the main body 51 covers an upper surface of the insulating housing 10, the front side edge 52 shields the front face of the insulating housing 10 and defines a gap 522 to engage with a block 33 formed on the insulating housing 10. The first and the second side edges 53, 54 respectively cover the side faces of the guiding arm 12. The first side edge 53 is formed with a plurality of latches 532 extending into corresponding latch holes 122 to plurality of latches 532 extending into corresponding latch holes 122 to fix the shielding 50 to the insulating housing 10 and defines a cut 530 for the ejector 40 to pass through. The second side edge 54 has a same configuration with the first side edge 53, it has a cut 540 and a plurality of latches 542.

Figure 4:
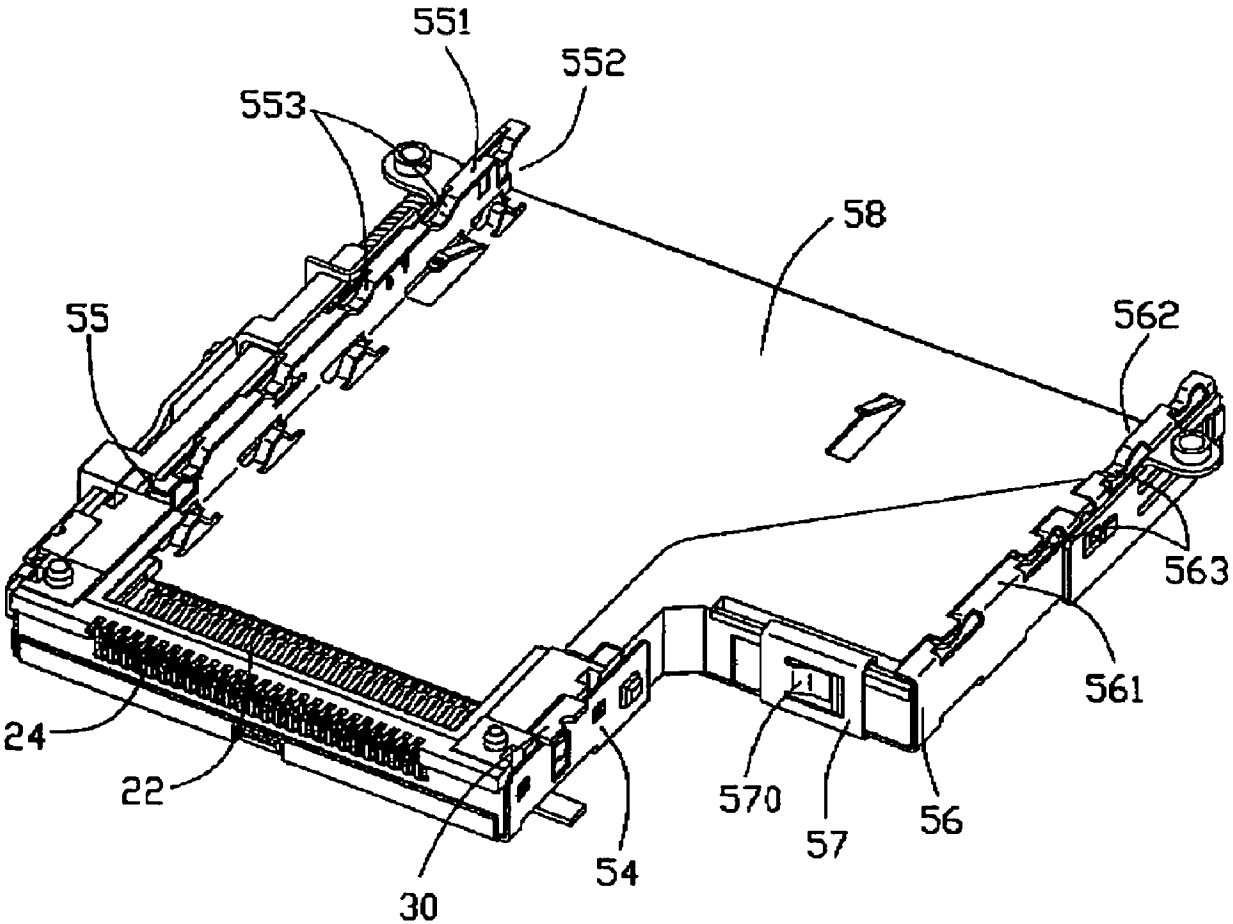
FIG. 4 is a perspective view of the card connector shown in FIG. 1, but from another aspect.

Referring to FIG. 4, the third and the fourth side edge 55, 56 are formed with horizontal plates 551, 561 extending inwardly to the card receiving space 58 from hemlines thereof, respectively. Guide grooves 552, 562 are defined between the horizontal plates 551, 561 and the main body 51 for guiding and holding the insertion ejection of the card. The horizontal plates 551, 561 are formed with a plurality of extrusive slices 553, 563 along an card inserting direction for positioning the card in an up and down sides. The longitudinal side edge 57 is bended backwardly from a hemline thereof to form a receive portion 571 (shown in FIG. 3) with a spring arm 570 extending therein for holding the guide element 60.

Referring to FIGS. 2 to 4, the guider element 60 is approximately in a triangle shape. The guider element 60 has a board 61 and a L-shaped perpendicular wall 62 extending forwardly and upwardly from a front end of the board 61. The board 61 is received in the receive portion 571 of the longitudinal side edge 57 and abuts against the fourth side edge 56, the perpendicular wall 62 abuts against the second side edge 54 and the longitudinal wall 57 of the shielding plate 50 with a projection 63 and a depressed portion 64 on an out surface thereof to engage with a fixing hole 543 of the second side edge 54 and a spring arm 570 of the longitudinal side edge 57, respectively. The perpendicular wall 62 is defined a guide channel 65 towards the card receiving space 58 for guiding the card inserting into or ejecting out of the card connector 1.

The stand off devices 70 have flakes 71 assembled on the side edges of the shielding 50 and engaging portions 72 soldered to a grounding pad of the printed board circuit. Further more the stand off device 70 in the same side with the ejector 40 is provided with a holding portion 73 (shown in FIG 5).

Figure 5:
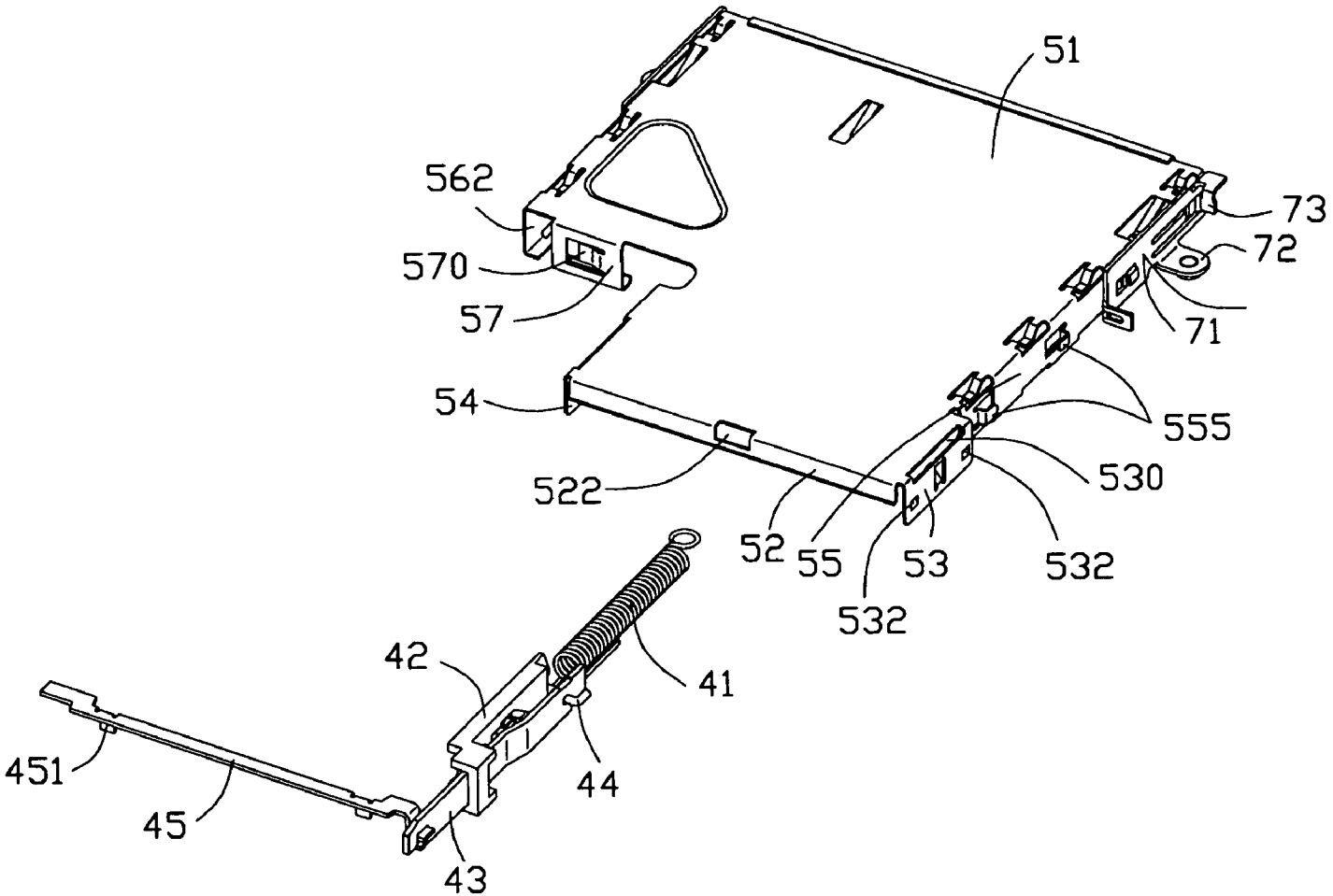
FIG. 5 is a perspective view of the card connector shown in FIG. 1, but only showing the shield and an ejector.
Figure 6:
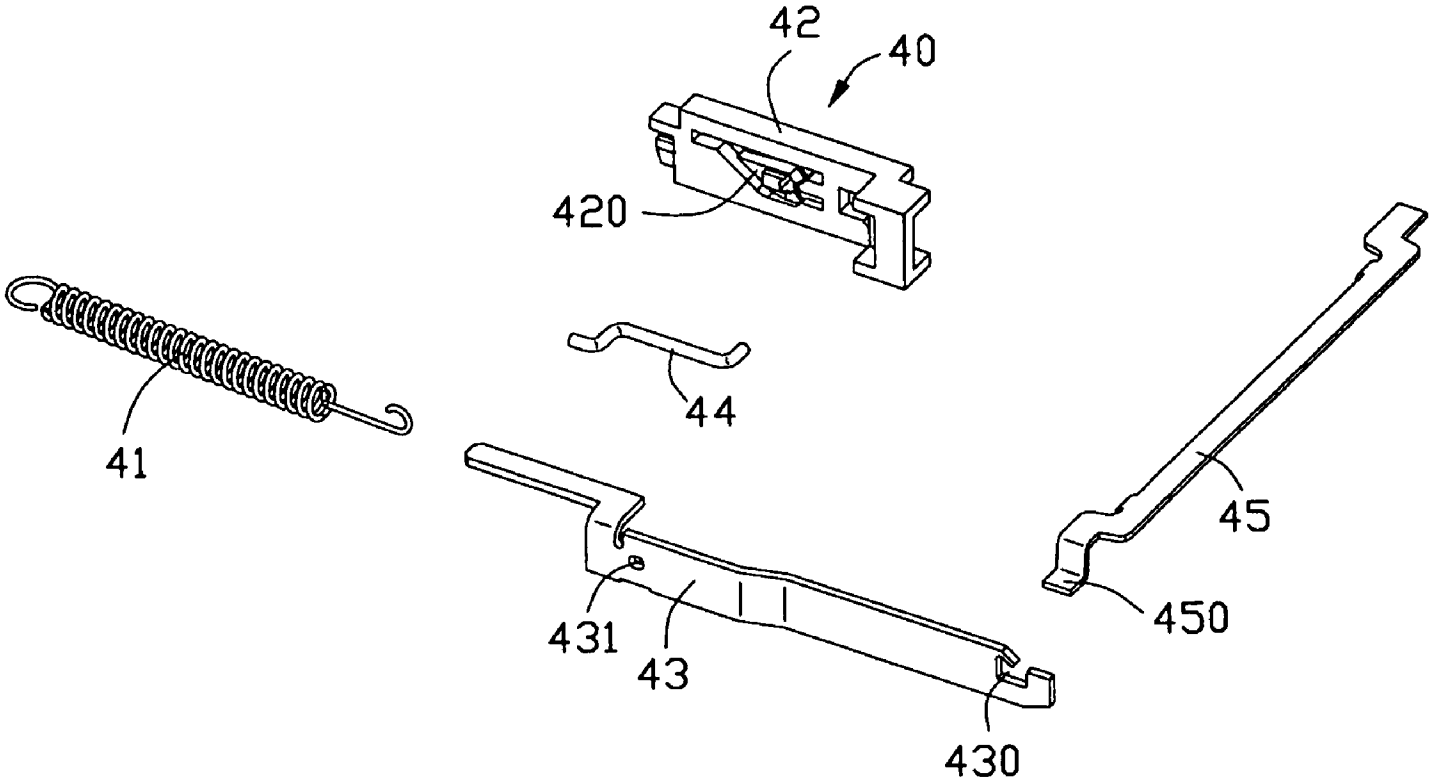
FIG. 6 is an exploded perspective view of the ejector shown in FIG. 5.

Referring to FIGS. 4 and 5, the ejector 40 is comprises a slider 42 defining a heart groove 420, a push rod 43 slidly assembled on the slider 42, a resilient member such as a spring 41, a link pin 44 and an ejecting rod 45. The push rod 43 and the link pin 44 serve as a push member slidly assembled on the slider 42. The slider 42 is securely disposed on the third side edge 55 by locking between a pair of locking portions 555 arranged along a card insertion direction in the shielding plate 50. One end the spring 41 is fasten to the holding portion 73 of the stand oil 70 and the other clasps the push rod 43 to slider toward an original position thereof. One end of the link pin 44 is locked in a hole 431 of the push rod 43 and another end is received and can slider in the heart groove 420 of the holding member 42. The ejecting rod 45 is located between the insulating housing 10 and the shielding 50 by passing through the cuts 530, 540 of the shielding 50 and one end 450 thereof is movably received in a limit hole 430 of the push rod 43. Because the ejector 40 is disposed on the third side edge 55 of the shielding 50 in virtue of opposite ends of the slider 42 locked between the locking portions 555 arranged along a card insertion direction, thus the ejector 40 is uploaded easily from the third side edge 55 in virtue of the slider 42 uploaded from the third side edge 55 along a vertical direction perpendicular to the card insertion direction.

The ejector 40 is a push-push type, during inserting the electrical card into the electrical card connector, a front end of the card push ejecting plates 451 (shown in FIG. 5) of the ejecting rod 45 to make the ejecting rod 45 move forward, so that the push rod 43 is also brought to move forward by the ejecting rod 45 and the link pin 44 slides in the heart groove 420. In this state, the spring 41 is stretched until the link pin 44 into a lock position of the heart groove 420, whereby the electrical card is fully inserted into the electrical card connector and electrical connects with the contacts 20. If go on push the electrical card forwardly, the link pin 44 is released from the lock position, then the push rod 43 move rearward driven by the resilience force of the spring 41 to then bring the ejecting rod 45 to eject the card out of the electrical card connector.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector comprising:

an insulating housing;

a plurality of contacts retained in the insulating housing;

a shielding provided with one end along a card insertion direction coupled on the housing, and defining a card receiving space together with the insulating housing with a card inserting opening at the other end of the shielding, the shielding having a pair of opposite side edges; and an ejector assembled on the shielding for ejecting the card, the ejector comprises a slider assembled on the shielding, a push member slideably assembled on the slider, a resilient member with one end thereof locked in the push member and an ejecting rod connecting with the push member, when a card is inserted into the card receiving space, the card pushes the ejecting rod to bring the push member to a lock position in the slider and the resilient member is stretched; when the card is further advanced, the card is ejected by the ejecting rod with the push member being in an original position by restoring resilient force of the resilient member.

2. The card connector as claimed in claim 1, further comprising stand off devices, and one stand off device disposed on a same side edge with the ejector comprises a holding portion.

3. The card connector as claimed in claim 2, wherein another end of the resilient member is locked in the holding portion of the stand off device.

4. The card connector as claimed in claim 1, wherein one of the side edges is in substantially linear configuration and the other of the side edges is in a step configuration so that the width of the card inserting opening is wider than that of the insulating housing.

5. The card connector as claimed in claim 4, wherein the ejector is assembled on the one side edge of the shielding.

6. The card connector as claimed in claim 1, wherein the push member comprises a push rod connecting with the ejecting rod and a link pin assembled on the push rod and sliding in a heart groove disposed in the slider.

7. A card connector comprising:

an insulating housing;

a plurality of contacts retained in the insulating housing and comprising a plurality of contacting portions:

a shielding covering the insulating housing and defining a card receiving space: and an ejector comprising a slider assembled to the shielding, a push rod connected and relatively movably with the slider an ejecting rod defining one end connected with the push rod, said ejecting rod extending and exposed into the card receiving space to eject the card, holding means to securely hold the push rod in a lock position where the card is electrically connected with the contacting portions of the contacts and to release the push rod from the lock position when pushing the card along a card insertion direction from the locking position, and a resilient member for urging the posh rod to move along a card ejection direction.

8. The card connector as claimed in claim 7, wherein said ejecting rod essentially extends transversely through a whole length of the housing with a distal end associatively supported by the shield.

9. The card connector as claimed in claim 7, wherein said hold means comprising a link pin assembled on the push rod and sliding in a heart groove disposed in the slider.

10. The card connector as claimed in claim 7, wherein said push rod is essentially exposed outside of the shield.

11. The card connector as claimed in claim 7, wherein the slider is essentially exposed outside of the shield.

12. The card connector as claimed in claim 7, wherein the resilient member is essentially exposed outside of the shield.

13. A card connector comprising:

a metal shielding defining a receiving space in which two different types of memory cards are insertable in a card insertion direction through an insert opening generally at a rear end of the metal shielding to respectively correspondingly connect with contacts mounted in an insulating housing at a front end of metal shielding; and an eject mechanism comprising a slider assembled to metal shielding, a push rod connected and relatively movable with the slider, an ejecting rod defining one end fixing with the push rod, said ejecting rod extending and exposed into the card receiving space to eject the cards, holding means to securely hold the push rod in a lock position where one of the cards is electrically connected with the contacts and to release the push rod from the lock position when pushing the card along the card insertion direction from the lock position, and a resilient member for urging the push rod to move along a card ejection direction.

14. The card connector as claimed in claim 13, wherein the front end of said metal shielding is narrower than the rear end thereof whereby said receiving space is generally L-shaped in a horizontal plane.

15. The card connector as claimed in claim 13, wherein said slider comprises a protrusion with a central hole defined therein, through which said push rod extends with two tips thereof disposed at two sides of protrusion along the card insertion direction.

16. The card connector as claimed in claim 13, wherein the hold means comprises a link pin assembled on the push rod and sliding in a heart groove disposed in the slider.

17. The card connector as claimed in claim 16, wherein one distal end or said link pin slides in said heart groove and is located at one side of push rod, and the other distal end thereof extends through the push rod and is located at the other side of push rod.

18. The card connector as claimed in claim 13, wherein further comprising a stand off disposed at same side of the metal shielding as the eject mechanism, with a transverse slot for receiving a front distal end of the push rod.

19. The card connector as claimed in claim 13, wherein said ejecting rod essentially extends transversely through a whole length of the housing with a distal end associatively supported by shield.

* * * * *